US009371634B2

(12) United States Patent
Flessa et al.

(10) Patent No.: US 9,371,634 B2
(45) Date of Patent: Jun. 21, 2016

(54) WATER FAUCET WITH A BASE PLATE

(71) Applicant: Grohe AG, Hemer (DE)

(72) Inventors: Thomas Flessa, Schwarzenbach a. Wald (DE); Karl Thomas, Menden (DE)

(73) Assignee: Grohe AG, Hemer (DE)

( * ) Notice: Subject to any disclaimer, the term of this patent is extended or adjusted under 35 U.S.C. 154(b) by 32 days.

(21) Appl. No.: 14/201,090

(22) Filed: Mar. 7, 2014

(65) Prior Publication Data

US 2014/0251476 A1 Sep. 11, 2014

(30) Foreign Application Priority Data

Mar. 7, 2013 (DE) ..... 10 2013 003 819

(51) Int. Cl.
*E03C 1/04* (2006.01)

(52) U.S. Cl.
CPC ..... *E03C 1/04* (2013.01); *E03C 1/0401* (2013.01); *E03C 2001/0416* (2013.01); *Y10T 137/9464* (2015.04)

(58) Field of Classification Search
CPC ..... E03C 1/04; E03C 1/0401; F16K 11/00; F16K 27/00
USPC ..... 137/801
See application file for complete search history.

(56) References Cited

U.S. PATENT DOCUMENTS

2006/0151034 A1* 7/2006 Klein ..... 137/801
2013/0180601 A1* 7/2013 Li et al. ..... 137/315.01

FOREIGN PATENT DOCUMENTS

DE 102 12 477 A1 10/2003

* cited by examiner

*Primary Examiner* — Kevin Lee
(74) *Attorney, Agent, or Firm* — Muncy, Geissler, Olds & Lowe, P.C.

(57) ABSTRACT

A water faucet having a housing and a base plate, whereby the housing has an interior space and an inner collar forming a bottom opening. The bottom opening forms at least two different opening widths and the base plate is made in the manner of a crossbar with such a width that in the cross position it can penetrate through the circular bottom opening only in the area of the larger opening width, and further a seat for the base plate is provided in the interior space adjacent to the larger opening width and parallel to the inner collar. Preferably, a bayonet closure is formed between the housing and the base plate. This allows for a simplified production and mounting.

10 Claims, 3 Drawing Sheets

WATER FAUCET WITH A BASE PLATE

This nonprovisional application claims priority under 35 U.S.C. §119(a) to German Patent Application No. 10 2013 003 819.7, which was filed in Germany on Mar. 7, 2013, and which is herein incorporated by reference.

BACKGROUND OF THE INVENTION

1. Field of the Invention

The present invention relates to a water faucet, which has at least one housing and a base plate. The base plate is used in particular to partially close a bottom opening of the housing, said opening being located in an area of the base, and thereby at the same time to fasten the water faucet to a vanity.

2. Description of the Background Art

DE 102 12 477 A1 discloses such a water faucet with a base plate. The base plate used therein is formed as a crossbar whose breadth is smaller than the clear width of the housing bottom opening, whereby the crossbar has a length that is the same or smaller than the diameter of an undercut behind an annular shoulder in the area of the housing opening in the faucet housing. The advantage of this design is that the crossbar can be inserted later in the faucet housing behind the annular shoulder by a slight tilting, whereby then a holder, with which the water faucet can be fastened to a vanity by bracing, can be placed on a bolt fastenable in the crossbar.

The water faucet proposed therein has already proven its worth many times, but takes into account only insufficiently further refinement in the case of housings for such water faucets. Thus, a housing of this type is now preferably produced using a half-shell technique. Very especially preferred, at least in this regard, is that these half-shells are to be produced by a casting process, particularly by a pressure casting process. Moreover, a (costly) mechanical reworking in particular is to be avoided.

It is preferred, furthermore, that the housing, for example, is made non-metallic, therefore is manufactured, for example, out of plastic. It is especially difficult here to provide threads and/or other mating receptacles. In addition, the manufacturing tolerance is much greater. All the same, the use of plastics provides the opportunity to realize the water flow directly in the half-shells, which can be glued, for example, to the housing.

SUMMARY OF THE INVENTION

On this basis, it is therefore an object of the present invention to solve the problems described with respect to the state of the art at least in part. Further, in order to simplify the mounting or for a permanent fastening of such a water faucet to a vanity, it is to be achieved that the water faucet can be securely held on the vanity during the installation as well. In particular, the turning and/or axial shifting of the fastening members relative to the housing during the mounting (and also afterwards during operation) are to be reduced or prevented.

It should be pointed out that the individually stated features can be combined in any technologically reasonable manner and illustrate further embodiment variants of the invention.

The water faucet comprises at least one housing and a base plate. The housing has an interior space and an inner collar forming a bottom opening, whereby the bottom opening forms at least two different opening widths. The base plate is made in the manner of a crossbar with such a width that in the cross position it can penetrate through the circular bottom opening only in the area of the larger opening width. A seat for the base plate is furthermore provided in the interior space adjacent to the larger opening width and parallel to the inner collar.

It is obvious that a water faucet regularly comprises further parts or components. Listed here by way of example are an operating lever, a spray plate, a cartridge, water lines, etc. The housing can be made as a one-piece or multi-piece part. In particular, the housing can also be made in the manner of half-shells, in any event in the bottom area near the fastening to a vanity.

The housing has an interior space, in which, for example, the water connections, a cartridge, etc., can be placed. In any event, this interior space in the installed state of the water faucet can also function to receive and securely hold the base plate. A preferably circumferential inner collar is formed, moreover, at the bottom end of the interior space. It is basically also possible that the inner collar has a plurality of partitions, which are spaced apart from one another. The inner collar projects, for example, proceeding from the housing radially into the interior space.

The inner collar is now designed such that it forms a bottom opening with at least two different sized opening widths. The opening width refers to the distance of the opposite areas of the inner collar. Different opening widths can be achieved, for example, in that the bottom opening does not have a circular cross section. The bottom opening accordingly can be made, for example, oval, angular, star-shaped, etc.

A special case is a bottom opening which is formed as a circular bottom opening with at least one recess.

Because the inner collar does not cover the entire cross section of the interior space, but is formed particularly over the entire circumference with a similar extension depth into the interior space, the circular bottom form is formed. Especially in cylindrical designs of the housing and accordingly a ring-shaped inner collar, an almost precise circular opening is formed with the inner collar (circular opening diameter). In the water faucet proposed here, this situation does not exactly exist, because the inner collar has at least one recess, which could be described, for example, as a type of indentation of the inner collar. In the area of said recess, for example, the circular opening diameter is enlarged (larger opening width) relative to other sections of the bottom opening (smaller opening width). The type and/or number of recesses should be provided particularly matched to the design and/or type of base plate. Preferably, a plurality (e.g., 2, 3, 4) of recesses is provided, so that in particular a directed guiding of the base plate during the insertion into the housing is made possible.

The matched design between the opening widths or recesses of the inner collar and the width of the base plate is preferably provided so that the base plate can penetrate through the bottom opening in the cross position (parallel to the mounting situation or horizontally) in fact only if a section of the crossbar is positioned in one or even each of the larger opening widths or recesses. In a rotated arrangement between the housing and base plate, accordingly the base plate cannot penetrate through the bottom opening in the cross position. Behind the inner collar or behind the larger opening widths/recesses in the interior space, then a seat for the base plate is provided, said seat extending at least partially parallel to the inner collar. It is provided in particular here that the base plate initially in the cross position penetrates through the inner collar and then can be turned/rotated still in the cross position behind the inner collar, and then integrated in a seat. The seat is formed downward (in the direction of the bottom) particularly by the inner collar itself. It is preferred further that a (separate) seat for (in each case) an end section of the base plate is also provided adjacent to each larger opening width or recess.

The water faucet is preferred in which two opposite recesses are provided in the inner collar. These then together form a larger opening width relative to the adjacent areas of the bottom opening. In particular, a clear arrangement of end sections of the base plate toward the housing can be predetermined here. Even if basically the opposite recesses can be made differently, it is nevertheless preferred that the end sections of the base plate are similar as are the corresponding recesses as well in the inner collar. This basically enables two different installation positions of the base plate relative to the housing. The two recesses in the inner collar are particularly located diametrically opposite in one plane.

According to an embodiment, it is proposed that the seat is positioned adjacent to the at least one larger opening width (or recess) in the circumferential direction. In particular, this seat is adjacent to an inner collar section adjacent in the circumferential direction. Thereby, the seat is formed in particular by an area of the interior space, which is positioned directly behind the bottom (circular) opening and offset in the circumferential direction to the larger opening width or recess.

It is furthermore preferred that an internal stop is formed in the interior space of the housing at a distance behind the at least one larger opening width or recess. The internal stop is used particularly to limit the axial movement of the base plate during immersion into the interior space, after it has passed through the larger opening width or recess. The distance of the internal stop to the larger opening width or recess corresponds preferably substantially to the height of the base plate or is (slightly) greater. It is also preferred that said internal stop extends in the circumferential direction, and therefore runs particularly also at least partially parallel to the inner collar. In particular, the internal stop and the inner collar limit at least in sections the seat for the base plate.

It is provided, further, that a bayonet closure is formed between the housing and the base plate. A bayonet closure is a rapidly producible and/or easily releasable mechanical connection of two parts, which can be connected together by plugging into one another and turning in the opposite direction and also be separated again.

It is preferred moreover that the housing is made with plastic and the base plate with metal. In this respect, it is basically possible that the plastic housing is also made as two parts with an axial joint, which is glued if necessary in the mounted state. In this regard, it is preferred further that the housing together with the inner collar, seat, internal stop, etc., is made as a single piece, particularly by plastic pressure die casting. The base plate is preferably made with a corrosion-resistant metal.

It is preferred moreover that the base plate is made with widened end sections. In other words, this also means that a central section of the base plate is narrower. This shape of the base plate makes it possible that on both sides of the base plate, for example, the water lines, connecting components, etc., can be passed through and/or an installation option for parts in the interior of the housing is still created. The widened end sections are used especially to realize a secure guiding and/or stopping of the base plate in the seat. In addition, sufficiently great mounting forces for fastening the water faucet to the vanity can also be realized in this way.

It is also preferred here that a through-hole is provided in at least one widened end section. It is provided in particular that a through-hole is provided in both end sections, whereby said hole can also be made differently.

The invention and the technical environment will be described below with the use of figures. As far as the same parts are used in the figures, these are provided with the same reference characters. It should be pointed out that the figures are schematic in nature and the invention is not limited to the shown exemplary embodiments. Shown are:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
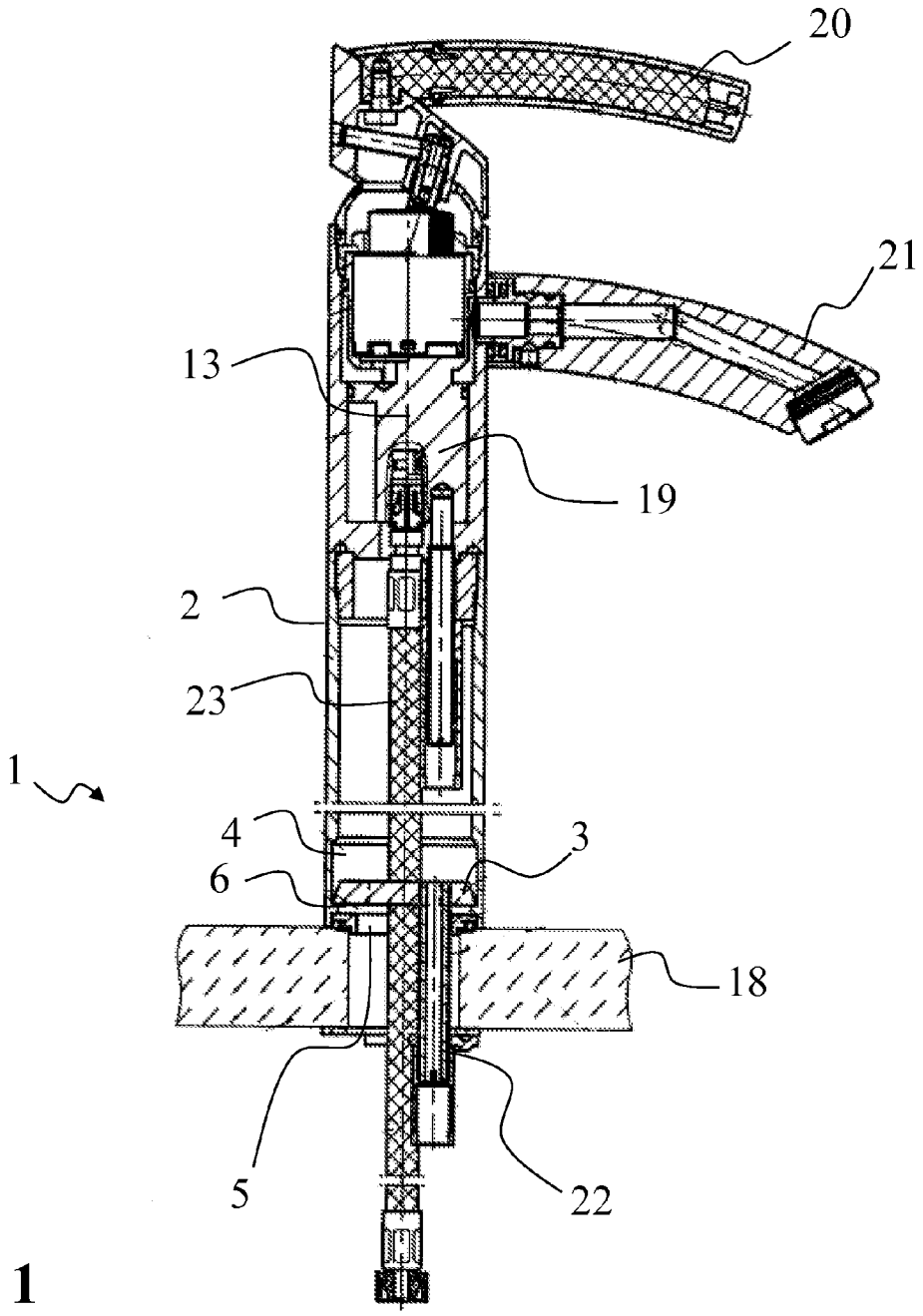
FIG. 1 is an example of a water faucet mounted on a vanity countertop.

FIG. 1 illustrates the structure of a water faucet 1, which has a housing 2. An operating lever 20, with which in particular mixing cartridge 19 can be operated to adjust the hot/cold water, is provided at the top on housing 2. Thus, the water supplied via water supply 23 to mixing cartridge 19 can be appropriately preconditioned and then delivered via outlet 21. FIG. 1 illustrates further that the above components also extend into interior space 4 of housing 2 or that these are positioned there.

Water faucet 1 is mounted vertically on a vanity 18 at the lower end of interior space 4, namely, via a corresponding bored hole through which the hose-like water supply 23 is also passed. At the same time, water faucet 1 is fastened here by means of base plate 3 and support rod 22, in that base plate 3 is braced, on the one hand, against inner collar 6 of housing 2 and, on the other, the bottom side of vanity 18 by means of support rod 22. For the mounting process and/or the durability of this fastening, it is significant how easily and/or precisely base plate 3 can be inserted through circular bottom opening 5 formed by inner collar 6 and fastened.

Figure 2:
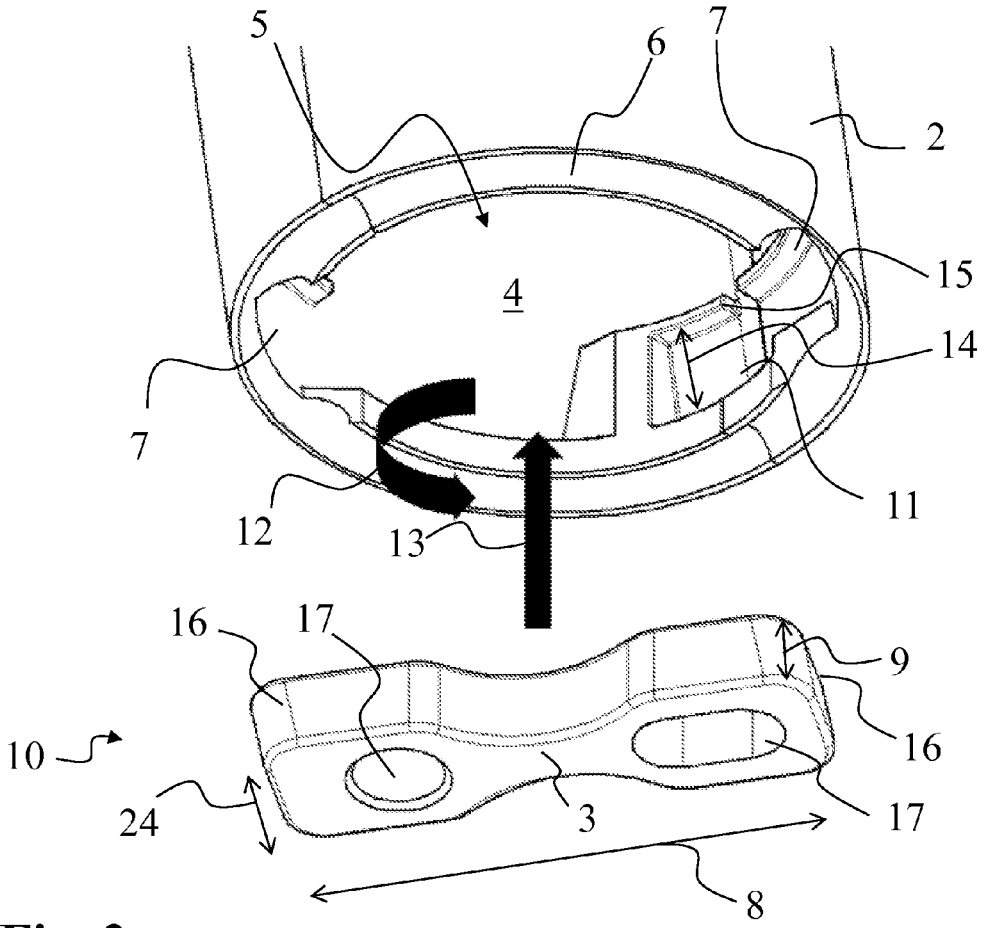
FIG. 2 is a perspective detail of the water faucet before mounting.

FIG. 2 illustrates a detail of water faucet 1 in the bottom area of housing 2, particularly also conjunction with the matchingly formed base plate 3. In the lower portion of FIG. 2, base plate 3 is shown in cross position 10 (e.g., horizontal position). The dimensions of base plate 3 are given here as width 8, breadth 24 (both in the horizontal plane or transverse plane), and height 9. The shown base plate 3 is formed in the manner of a crossbar with two widened end sections 16. A through-hole 17 (especially with a thread) is made in a (left) end section 16, whereas a through-hole 17 in the manner of a long hole is formed in the second widened end section 16.

Positioned or oriented above this, a bottom section of housing 2 is shown from below. Especially evident here is inner collar 6, which has two diametrically opposite recesses 7

(together forming the largest opening width of the bottom opening). Width 8 of base plate 3 is now selected so that base plate 3 in the shown cross position 10 and with an axial movement (along the direction of axis 13) can penetrate inner collar 6 and be inserted in interior space 4 only in the area of both recesses 7. If, during the mounting, base plate 3 has entered interior space 4 over the entire height 9, base plate 3 butts against an internal stop 15. There, base plate 3 is then turned in circumferential direction 12 (while remaining in cross position 10). In so doing, end sections 16 sink into two seats 11 disposed adjacent to recesses 7 in circumferential direction 12. This turning proceeds until end sections 16 of base plates 3 reach a stop 27. Consequently, the two seats 11 are each limited here by inner collar 6, internal stop 15, and stop 27.

Figure 3:
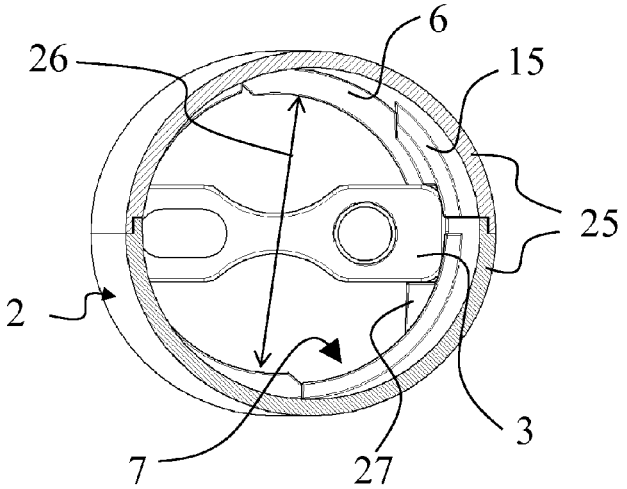
FIG. 3 is a plan view of a base plate mounted in the housing.

FIG. 3 now shows a cross section through a mounted embodiment variant. It is evident in one respect that housing 2 is formed with two housing halves 25. Here, a plan view is shown from the interior space outwards through circular bottom opening 5. Also visible is inner collar 6, which basically defines diameter 26 (small opening width) of circular bottom opening 5. Nevertheless, a widening of the diameter (larger opening width) is realized here in the area of recesses 7. In the shown position, base plate 3 (turned about 90 angular degrees relative to the insertion position through recesses 7) lies against stop 27, so that in this position both a securing against further turning and also an axial securing against an assembly force from below are assured.

Figure 4:
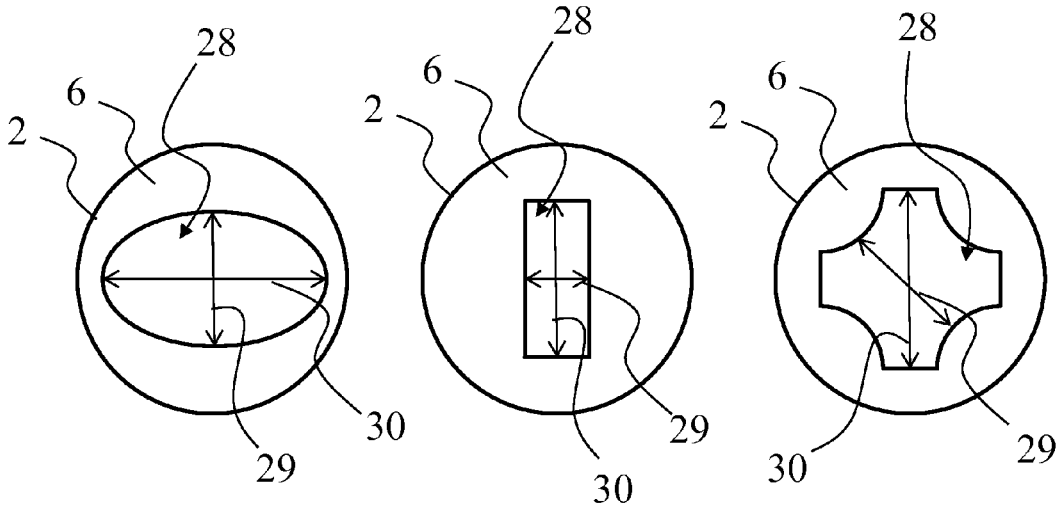
FIG. 4 are different embodiments of a bottom opening with different opening widths.

FIG. 4 illustrates a number of embodiment variants of a noncircular bottom opening 28 formed by inner collar 6, whereby in each case at least one small opening width 29 and a larger opening width 30 are formed. These bottom openings 28 can be described as oval, angular, or star-shaped. It is apparent that there are also other forms for a bottom opening that can fulfill the same function, as they were described above particularly in conjunction with the design of a recess.

The invention in this respect attains the aforementioned objects and provides in particular a water faucet that is simple to produce and easy and rapid to install.

As a precaution, it should also be pointed out that the combinations of technical features as shown in the figures are not obligatory in general. The technical features of a figure can be combined with other technical features of another figure and/or the general description. Something different should apply only if the combination of features was shown explicitly here and/or the person skilled in the art realizes that otherwise the basic functions of the device can no longer be fulfilled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A water faucet comprising:

a housing having an interior space and an inner collar forming a bottom opening, the bottom opening forming at least two different opening widths;

a base plate having a width such that in a cross position, the base plate penetrates through the bottom opening only in an area of the larger opening width; and a seat for the base plate being arranged in the interior space adjacent to the larger opening width and parallel to the inner collar.

2. The water faucet according to claim 1, wherein the bottom opening is made as a circular bottom opening with at least one recess.

3. The water faucet according to claim 2, wherein two opposite recesses are provided in the inner collar.

4. The water faucet according to claim 1, wherein the seat is positioned adjacent to the larger opening width in the circumferential direction.

5. The water faucet according to claim 1, wherein an internal stop is formed in the interior space of the housing at a distance behind the larger opening width.

6. The water faucet according to claim 1, wherein a bayonet closure is formed between the housing and the base plate.

7. The water faucet according to claim 1, wherein the housing is made with plastic and the base plate with metal.

8. The water faucet according to claim 1, wherein the base plate is made with widened end sections.

9. The water faucet according to claim 8, wherein a through-hole is provided in at least one widened end section.

10. The water faucet according to claim 8, wherein a through-hole is provided in both widened end sections, and wherein one of the through-holes is elongated and another one of the through-holes is threaded.

* * * * *